US011660604B2

(12) United States Patent
Argenziano

(10) Patent No.: US 11,660,604 B2
(45) Date of Patent: May 30, 2023

(54) MILLING MACHINE

(71) Applicant: Caterpillar Paving Products Inc., Brooklyn Park, MN (US)

(72) Inventor: Nicholas James Argenziano, Otsego, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 128 days.

(21) Appl. No.: 16/750,107

(22) Filed: Jan. 23, 2020

(65) Prior Publication Data

US 2020/0156079 A1 May 21, 2020

(51) Int. Cl.
*B02C 4/40* (2006.01)
*B02C 25/00* (2006.01)
*E01C 23/088* (2006.01)

(52) U.S. Cl.
CPC ..... *B02C 4/40* (2013.01); *B02C 25/00* (2013.01)

(58) Field of Classification Search
CPC ..... B02C 4/40; B02C 25/00; E01C 23/088
See application file for complete search history.

(56) References Cited

U.S. PATENT DOCUMENTS 3,793,752 A 2/1974 Snyder
3,946,506 A * 3/1976 Snow, Jr. ..... E01C 19/004 37/382
5,114,267 A * 5/1992 Smith ..... E01C 19/48 404/108
6,923,508 B2 8/2005 Holl et al.
7,370,916 B2 5/2008 Ley et al.
7,458,645 B2 12/2008 Hall et al.
9,328,467 B2 5/2016 Forster et al.
9,422,677 B2 8/2016 Franzmann et al.
2007/0180644 A1 8/2007 Tessier et al.
2015/0197901 A1* 7/2015 Franzmann ..... E01C 23/088 299/1.5
2021/0108379 A1* 4/2021 Frank ..... E01C 23/127

* cited by examiner

*Primary Examiner* — Matthew Katcoff
*Assistant Examiner* — Mohammed S. Alawadi
(74) *Attorney, Agent, or Firm* — von Briesen & Roper, s.c.

(57) ABSTRACT

A milling machine includes a scraper door and a control system adapted to control a movement of the scraper door. The control system includes at least one actuator coupled with the scraper door. An extension of the at least one actuator allows lowering of the scraper door and a retraction of the at least one actuator allows raising of the scraper door. The control system also includes a first valve. The control system further includes a second valve. The control module is configured to receive an input signal for raising the scraper door. The control module is also configured to transmit a first signal for operating the first valve in the second position and a second signal for controlling an amount of opening of the second valve for the retraction of the at least one actuator in order to raise the scraper door.

17 Claims, 5 Drawing Sheets

MILLING MACHINE

TECHNICAL FIELD

The present disclosure relates to a milling machine. More particularly, the present disclosure relates to a scraper door associated with the milling machine.

BACKGROUND

Milling machines typically include a scraper door and a milling drum disposed within a chamber. After conclusion of a milling operation, a work surface on which the milling operation is performed needs to be cleaned. The scraper door is used to clean the work surface behind the milling drum of the milling machine. Further, the scraper door also assists in retention of material in the chamber which is then conveyed out of the opposite side of the chamber to a conveyor system.

The scraper door is typically raised and lowered by one or more hydraulic actuators. When the scraper door is in operation, a weight of the scraper door and the hydraulic actuators may apply a pressure on the work surface. Further, excessive pressure on the work surface may damage the work surface. In some cases, while leaving thin amounts of road unmilled, the heavy weight of the scraper door and the pressure from the hydraulic actuators may cause damage to the work surface, which is not desirable.

U.S. Pat. No. 6,923,508 describes a stripping means for milling rolls of a construction machine. The stripping means comprises at least one stripping blade arranged behind the milling roll in traveling direction so as to be adjustable in height, which is able to glide over the surface milled or to be milled by the at least one milling roll, it is provided that the stripping blade covers the maximum milling width, and that a mounting means adjustable in height relative to the stripping blade is arranged for at least one lower stripper portion adapted to the respectively used milling roll or milling rolls, the lower stripper portion being able to be positioned, by means of the mounting means, in a position corresponding to the milling roll within the width of the stripping blade.

SUMMARY OF THE DISCLOSURE

In an aspect of the present disclosure, a milling machine is provided. The milling machine includes a scraper door. The milling machine also includes a control system adapted to control a movement of the scraper door. The control system includes at least one actuator coupled with the scraper door. An extension of the at least one actuator allows lowering of the scraper door and a retraction of the at least one actuator allows raising of the scraper door. The control system also includes a first valve in fluid communication with the at least one actuator. The first valve is operable in a first position for the extension of the at least one actuator and a second position for the retraction of the at least one actuator. The control system further includes a second valve in fluid communication with the first valve. The second valve is adapted to control an amount of fluid pressure being directed towards the at least one actuator via the first valve. The control system includes a control module communicably coupled with the first valve and the second valve. The control module is configured to receive an input signal for raising the scraper door. The control module is also configured to transmit a first signal for operating the first valve in the second position and a second signal for controlling an amount of opening of the second valve for the retraction of the at least one actuator in order to raise the scraper door.

In another aspect of the present disclosure, a milling machine is provided. The milling machine includes a scraper door. The milling machine also includes a control system adapted to control a movement of the scraper door. The control system includes a pair of actuators coupled with the scraper door. An extension of each of the pair of actuators allows lowering of the scraper door and a retraction of each of the pair of actuators allows raising of the scraper door. The control system also includes a first valve in fluid communication with the pair of actuators. The first valve is operable in a first position for the extension of the pair of actuators and a second position for the retraction of the pair of actuators. The control system further includes a second valve in fluid communication with the first valve. The second valve is adapted to control an amount of fluid pressure being directed towards the pair of actuators via the first valve. The control system includes a control module communicably coupled with the first valve and the second valve. The control module is configured to receive an input signal for raising the scraper door. The control module is also configured to transmit a first signal for operating the first valve in the second position and a second signal for controlling an amount of opening of the second valve for the retraction of the pair of actuators in order to raise the scraper door.

In yet another aspect of the present disclosure, a control system adapted to control a movement of a scraper door associated with a machine is provided. The control system includes at least one actuator coupled with the scraper door. An extension of the at least one actuator allows lowering of the scraper door and a retraction of the at least one actuator allows raising of the scraper door. The control system also includes a first valve in fluid communication with the at least one actuator. The first valve is operable in a first position for the extension of the at least one actuator and a second position for the retraction of the at least one actuator. The control system further includes a second valve in fluid communication with the first valve. The second valve is adapted to control an amount of fluid pressure being directed towards the at least one actuator via the first valve. The control system includes a control module communicably coupled with the first valve and the second valve. The control module is configured to receive an input signal for raising the scraper door. The control module is also configured to transmit a first signal for operating the first valve in the second position and a second signal for controlling an amount of opening of the second valve for the retraction of the at least one actuator in order to raise the scraper door.

Other features and aspects of this disclosure will be apparent from the following description and the accompanying drawings.

DETAILED DESCRIPTION

Figure 1:
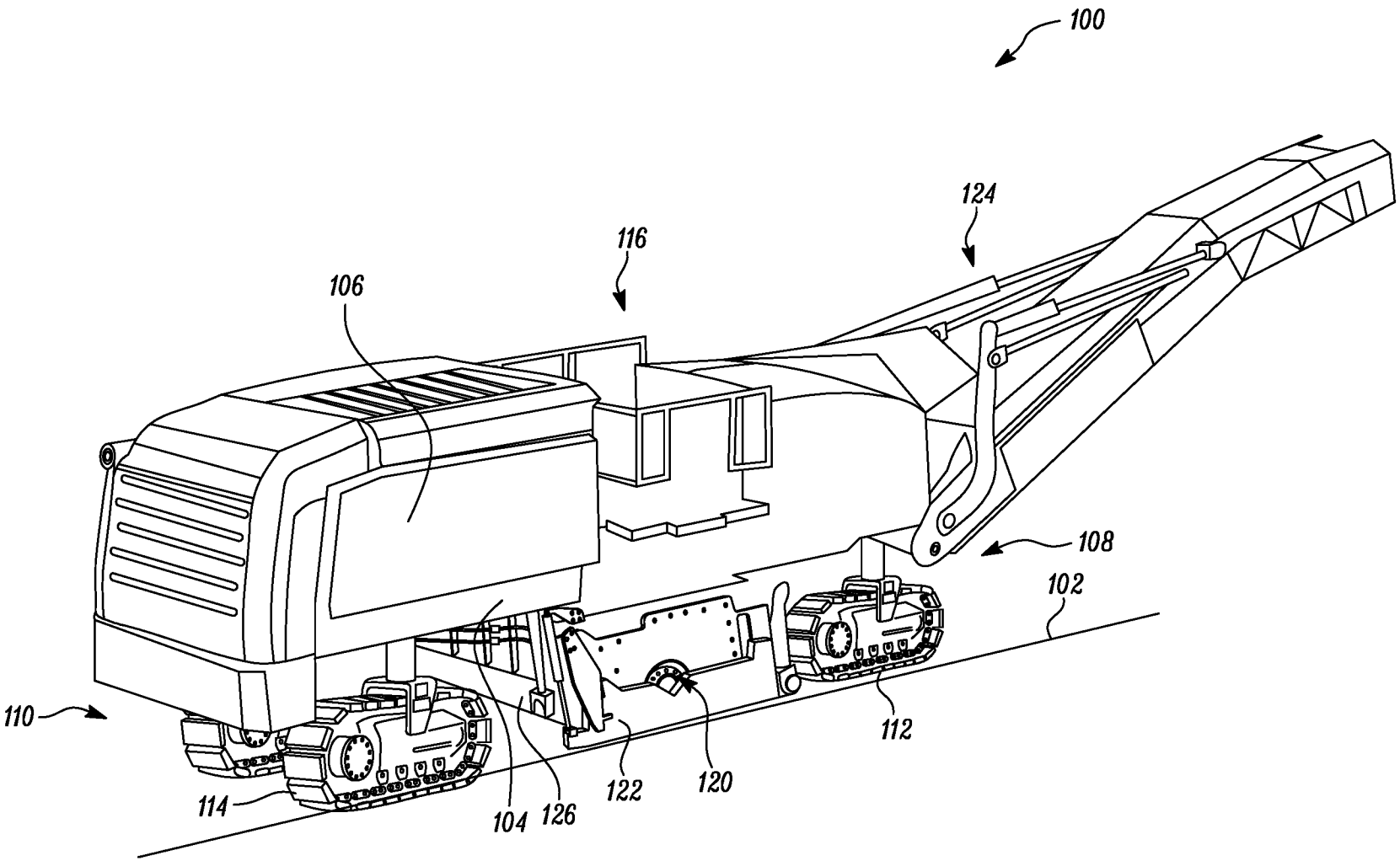
FIG. 1 is a perspective view of a milling machine, according to one embodiment of the present disclosure.

Wherever possible, the same reference numbers will be used throughout the drawings to refer to the same or like parts. FIG. 1 is a perspective view of a milling machine 100, according to one embodiment of the present disclosure. The milling machine 100 is embodied as a cold planer herein, without limiting the scope of the present disclosure. The milling machine 100 operates on a ground surface 102 for performing a milling operation on the ground surface 102. The milling machine 100 includes a frame 104 and an engine enclosure 106 attached to the frame 104. The engine enclosure 106 houses an engine (not shown). The engine is generally an internal combustion engine that provides propulsion power to the milling machine 100 and also powers various components of the milling machine 100.

The milling machine 100 defines a front end 108 and a rear end 110. A pair of front tracks 112 are defined proximate to the front end 108 of the milling machine 100. Further, a pair of rear tracks 114 are defined proximate to the rear end 110 of the milling machine 100. Alternatively, the milling machine 100 may include wheels (not shown) instead of the tracks 112, 114. The milling machine 100 has an operator platform 116. When the milling machine 100 is embodied as a manual or semi-autonomous machine, an operator of the milling machine 100 may sit or stand at the operator platform 116 to operate the milling machine 100. The operator platform may include various input devices, such as an input device 118. The input device 118 is embodied as a user interface that allows the operator or a maintenance/servicing personnel to provide inputs for performing one or more machine tasks. Further, the first input device 110 may also provide various notifications to the operator or personnel to assist in improved handling of the milling machine 100.

The milling machine 100 also includes a rotor chamber 120 defined between the front and rear tracks 112, 114. The rotor chamber 120 is an enclosed space. The rotor chamber 120 is enclosed by a first plate 122 and a second plate (not shown) at either sides of the milling machine 100. Further, a rotor (not shown) that is rotatably coupled to the frame 104 lies within the rotor chamber 120. The rotor includes a generally cylindrical member and a number of cutting assemblies disposed on the cylindrical member. A portion of the cutting assemblies contact the ground surface 102 for removing material therefrom.

Further, the milling machine 100 includes a conveyor system 124. The conveyor system 124 may be pivotally connected to the frame 104 and is used to transport material away from the rotor chamber 120 and into a receptacle (not shown). The conveyor system 124 includes one or more conveyors for transportation of material. Further, the milling machine 100 includes a scraper door 126. The scraper door 126 generally extends between the first plate 122 and the second plate. Further, the scraper door 126 is generally rectangular in shape. A size of the scraper door 126 is based on a size of the rotor.

The scraper door 126 is used to clean a portion of the ground surface 102 that is milled by the milling machine 100. More particularly, the scraper door 126 glides over a milled surface to clean the milled surface from remaining milled-off material. In some examples, the scraper door 126 is arranged in a height-adjustable manner. Further, the milled-off material is collected in the rotor chamber 120 and is carried away from the rotor chamber 120 by the conveyor system 124. In some examples, the scraper door 126 is embodied as a molded cardboard door.

Figure 2:
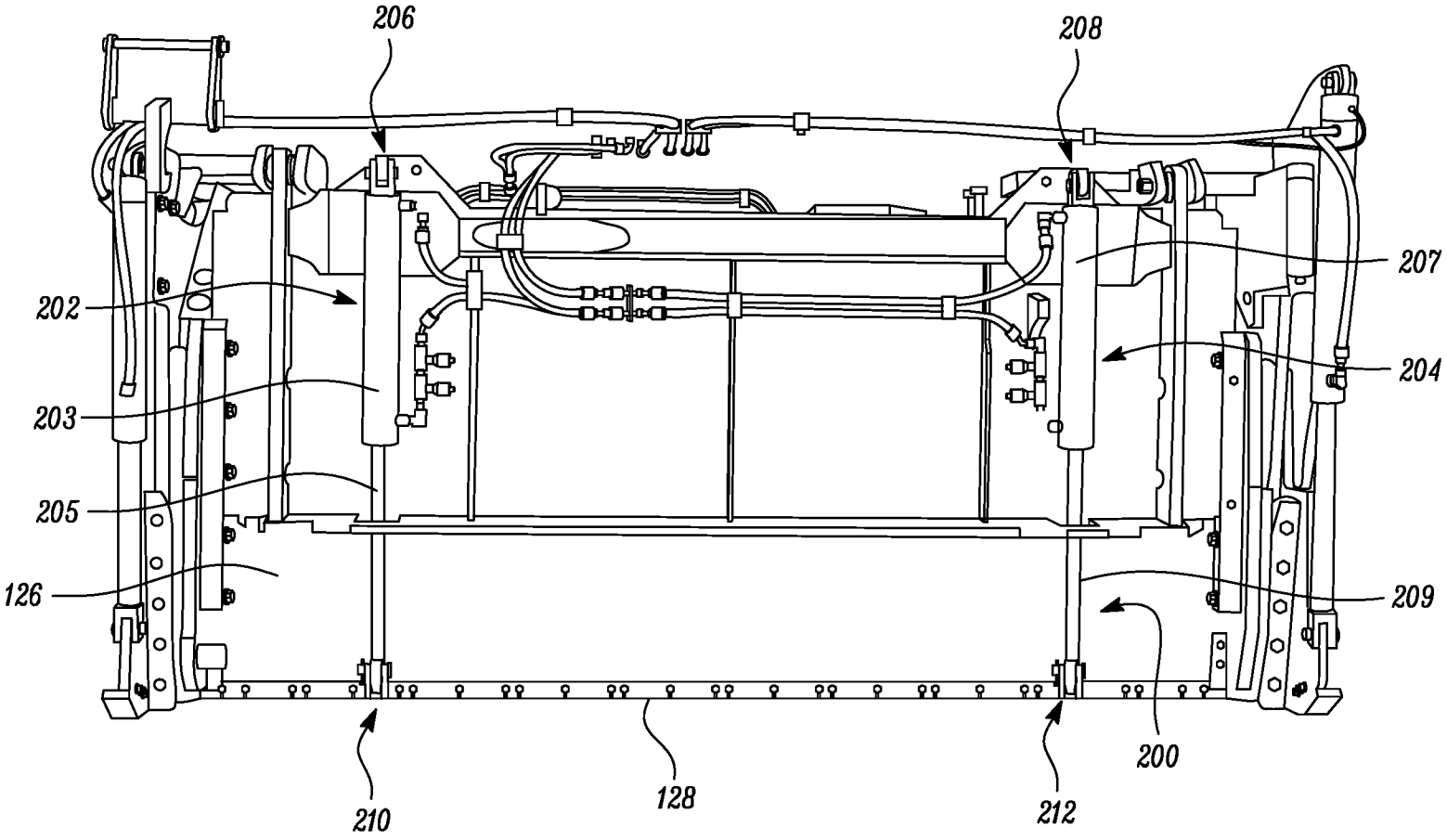
FIG. 2 illustrates a scraper door associated with the milling machine shown in FIG. 1, according to one embodiment of the present disclosure.
Figure 3:
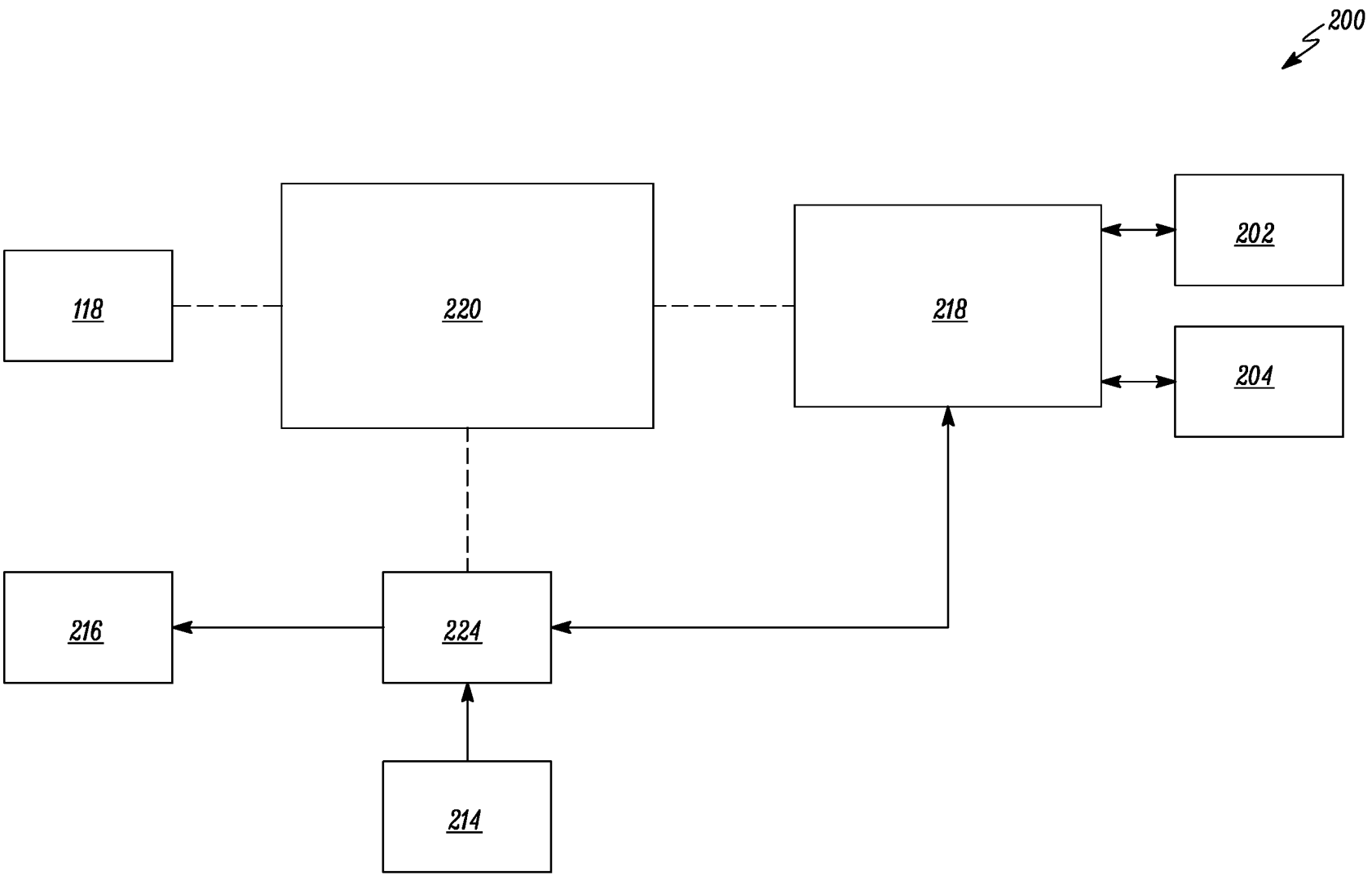
FIG. 3 is a block diagram illustrating a control system for controlling a movement of the scraper door of FIG. 2.
Figure 4:
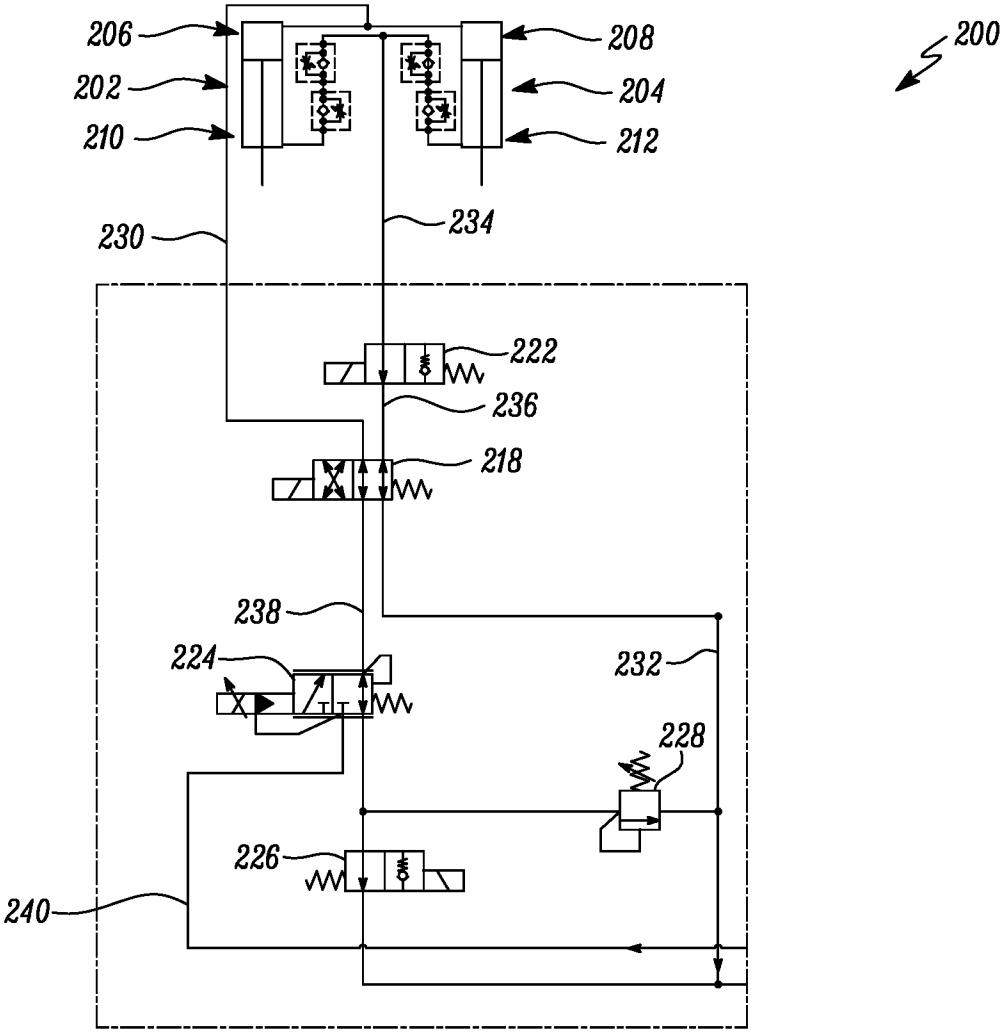
FIGS. 4 and 5 illustrate a hydraulic section of the control system of FIG. 2.
Figure 5:
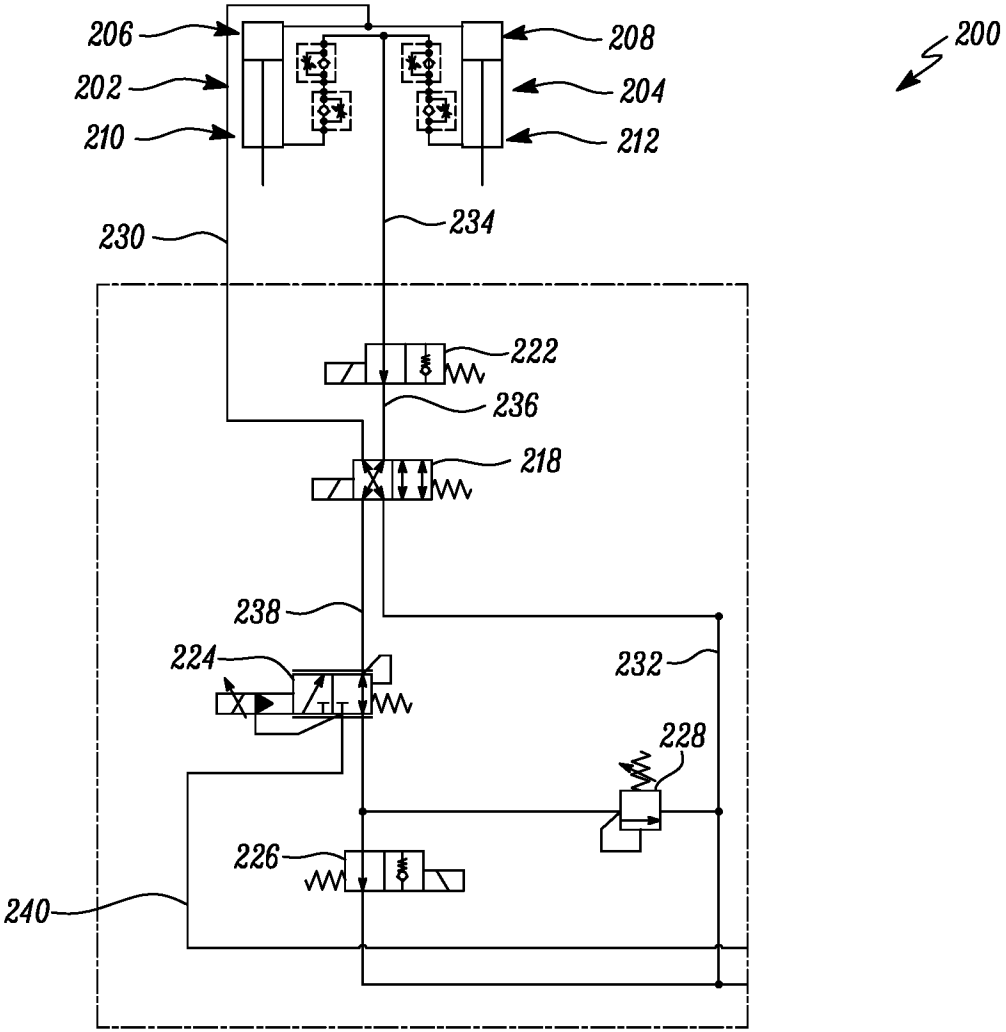

Referring now to FIG. 2, the milling machine 100 includes a control system 200 to control a movement of the scraper door 126. More particularly, the scraper door 126 may be raised or lowered based on an operation of the control system 200. The control system 200 includes one or more actuators 202, 204 coupled with the scraper door 126. In the illustrated example, the control system 200 includes a pair of actuators 202, 204. The actuators 202, 204 are embodied as hydraulic actuators. The actuators 204 includes a cylinder 203 and a rod 205. Further, a piston (not show) and the rod 205 reciprocates within the cylinder 203. The actuator 204 includes a cylinder 207 and a rod 209. Further, a piston (not show) and the rod 209 reciprocates within the cylinder 207 The actuators 202, 204 include a head end 206, 208 coupled with the frame 104 of the milling machine 100 and a rod end 210, 212 coupled with the scraper door 126. The rod ends 210, 212 of the actuators 202, 204 are coupled proximate to a lower portion 128 of the scraper door 126.

Further, an extension of the actuators 202, 204 allow lowering of the scraper door 126 and a retraction of the actuators 202, 204 allow raising of the scraper door 126. More particularly, in order to lower the scraper door 126 fluid pressure is directed towards the head ends 206, 208 of the respective actuators 202, 204. Whereas, in order to raise the scraper door 126 fluid pressure is directed towards the rod ends 210, 212 of the respective actuators 202, 204. A fluid, such as a hydraulic fluid, may flow in and out of the actuators 202, 204 to facilitate movement of the actuators 202, 204. The fluid is received by the head ends 206, 208 or the rod ends 210, 212 from a pressurized fluid source 214 associated with the control system 200, such as an accumulator. Further, the fluid exiting the head ends 206, 208 or the rod ends 210, 212 is directed towards a tank 216 associated with the control system 200. Moreover, the actuators 202, 204 may include position sensors (not shown) that generate signals indicative of a position of the actuators 202, 204.

Further, the control system 200 includes a first valve 218. The first valve 218 is in fluid communication with the actuators 202, 204. The first valve 218 is in fluid communication with the actuators 202, 204 via a fluid line 230. Further, the first 218 is in fluid communication with the tank 214 via a fluid line 232. The first valve 218 is operable in a first position for the extension of the actuators 202, 204 and a second position for the retraction of the actuators 202, 204. More particularly, when the first valve 218 is in the first position, the first valve 218 is in fluid communication with the head ends 206, 208 of the respective actuators 202, 204. Further, when the first valve 218 is in the second position, the first valve 218 is in fluid communication with the rod ends 210, 212 of the respective actuators 202, 204. The first valve 218 switches between the first and second positions based on signals received from a control module 220. The first valve 218 is embodied as a solenoid controlled valve.

Further, the control system 200 includes a third valve 222. The third valve 222 is disposed between the first valve 218 and the rod ends 210, 212 of the respective actuators 202, 204. The third valve 222 is in fluid communication with the rod ends 210, 212 via a fluid line 234. Further, the third valve 222 is in fluid communication with the first valve 218 via a fluid line 236. The third valve 222 is embodied as a float lock valve. When actuated, the third valve 222 allows free flow of fluid therethrough. However, when the third valve 222 is de-actuated, the third valve 222 allows locking of the scraper door 126 in a desired position by restricting fluid flow from the rod ends 210, 212 of the respective actuators 202, 204. The third valve 222 includes a check valve such that the third valve 222 restricts any fluid flow from the rod ends 210, 212 towards the tank 216 to lock the scraper door 126 in the desired position.

Further, the control system 200 includes a second valve 224 in fluid communication with the first valve 218. The second valve 224 is in fluid communication with the first valve 218 via a fluid line 238. The second valve 224 is in fluid communication with the pressurized fluid source 214 via a fluid line 240. The second valve 224 controls an amount of fluid pressure being directed towards the actuators 202, 204 via the first valve 218. The second valve 224 includes a proportional pressure reducing valve. It should be noted that an amount of opening of the second valve 224 is based on an input signal. More particularly, the second valve 224 may open partially or fully based on the input signal. The amount of opening of the second valve 224 is based on a desired fluid pressure to which the head ends 206, 208 or the rod ends 210, 212 of the respective actuators 202, 204 need to be subjected. It should be noted that the input signal is provided by an operator of the milling machine 100. In some examples, the input device 118 may be used to provide the input signal. The second valve 224 is embodied as a solenoid controlled valve.

Further, the control system 200 includes a fourth valve 226 and a fifth valve 228. The fourth valve 226 generally allows free flow of fluid therethrough, however, when the fourth valve 226 is actuated, the fourth valve 226 checks the flow so that fluid can flow through the fifth valve 228. The fourth valve 226 includes a check valve and the fifth valve 228 is embodied as a pressure relief valve. The fourth and fifth valves 226, 228 are actuated only when the scraper door 126 is to be fully raised. More particularly, when the scraper door 126 is to be fully raised, the fourth and fifth valves 226, 228 provide a pressure spike for fully raising the scraper door 126.

When the scraper door 126 is to be raised or lowered, pressurized fluid from the pressurized fluid source 214 flows through the second valve 224. The pressurized fluid is then directed towards the head ends 206, 208 or the rods ends 210, 212 via the first valve 218. The pressurized fluid causes the pistons and the rods 205, 209 to move towards the head ends 206, 208 or the rods ends 210, 212, based on application requirements. Further, fluid exiting the head ends 206, 208 or the rods ends 210, 212 flows through the third valve 222 and the first valve 218 to return to the tank 216.

The control system 200 includes the control module 220 communicably coupled with the first valve 218 and the second valve 224. Further, the control module 220 is also communicably coupled with the third valve 226. When the scraper door 126 is to be lowered, the operator of the milling machine 100 may use the input device 118 to send an input signal to the control module 220 for initiating the lowering of the scraper door 126. The control module 220 in turn sends a signal to operate the first valve 218 in the first position.

Further, the control module 220 also controls the amount of opening of the second valve 224 based on the input signal. The amount of opening of the second valve 224 is based on a desired fluid pressure to be applied at the head ends 206, 208 of the respective actuators 202, 204. The desired fluid pressure may be selected by the operator from a number of pressure values. For example, the operator may select if the head ends 206, 208 need be subjected to 10% of a maximum allowable pressure, 20% of the maximum allowable pressure, and so on. Based on the selection made by the operator, the control module 220 controls the amount of opening of the second valve 224 for lowering the scraper door 126.

Further, when the scraper door 126 is to be fully raised, the operator of the milling machine 100 may use the input device 118 to send an input signal to the control module 220 for initiating the raising of the scraper door 126. The control module 220 in turn sends a signal to operate the first valve 218 in the second position. Further, the control module 220 also controls the amount of opening of the second valve 224 based on the input signal. Moreover, in order to fully raise the scraper door 126, high fluid pressure is directed towards the rod ends 210, 212. For this purpose, the fourth valve 226 blocks a tank line from the second valve 224, such that high pressure fluid flows over the fifth valve 228 to provide a spike in pressure. Thus, in such a situation, the fourth valve 226 is checked to restrict any fluid flow therethrough.

Further, in some situations, a weight of the scraper door 126 in addition to a force applied by the actuators 202, 204 may damage a portion of the ground surface 102, and more particularly, the recently milled surface. The present disclosure is related to a technique wherein the actuators 202, 204 are retracted by a small amount in order to apply a lifting force on the scraper door 126 to reduce the weight acting on the ground surface 102 from the scraper door 126. For this purpose, the control module 220 controls the first and second valves 218, 224 in order to allow retraction of the actuators 202, 204. More particularly, the control module 220 receives the input signal for raising the scraper door 126.

The input signal is provided by the operator using the input device 118. The input signal is indicative of a desired fluid pressure to be applied at the rod ends 210, 212 of the respective actuators 202, 204. The desired fluid pressure may be selected by the operator from a number of pressure values. For example, the operator may select if the rod ends 210, 212 need be subjected to 10% of a maximum allowable pressure, 20% of the maximum allowable pressure, and so on. It should be noted that the desired fluid pressure selected by the operator may correspond to a small amount of fluid pressure that is sufficient to lift the scraper door 126 so that the weight of the scraper door 126 acting on the ground surface 102 may decrease.

Further, the control module 220 transmits a first signal for operating the first valve 218 in the second position and a second signal for controlling an amount of opening of the second valve 224 for the retraction of the actuators 202, 204 in order to raise the scraper door 126. Further, the second valve 224 opens by an amount such that the desired fluid pressure can be applied at the rod ends 210, 212. It should be noted that the control module 220 controls the amount of opening of the second valve 224 based on the input signal. More particularly, based on the input signal from the operator, the control module 220 may in turn control the amount of opening of the second valve 224 for raising the scraper door 126.

Moreover, as the first valve 218 is switched to the second position, the fluid pressure is directed towards the rod ends 210, 212 of the respective actuators 202, 204 to allow raising of the scraper door 126. The fluid pressure causes movement of the piston and the rods 205, 209 towards the head ends 206, 208 which in turn causes raising of the scraper door 126.

The control module 220 may embody a single microprocessor or multiple microprocessors for receiving signals from various components of the milling machine 100. Numerous commercially available microprocessors may be configured to perform the functions of the control module 220. It should be appreciated that the control module 220 may embody a machine microprocessor capable of controlling numerous machine functions. A person of ordinary skill in the art will appreciate that the control module 220 may additionally include other components and may also perform other functions not described herein.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The control system 200 associated with the milling machine 100 described herein provides a simple, effective, and cost-efficient solution for slightly lifting the scraper door 126 in order to reduce the weight acting on milled surfaces by the scraper door 126. More particularly, the control system 200 includes the valves 218, 222, 224, 226, 228 and the control module 220 that controls the valves 218, 222, 224, 226, 228 for retraction of the actuators 202, 204 to lift the scraper door 126.

The control system 200 described herein eliminates any possibility of damage to milled surfaces due to the weight of the scraper door 126. The low lifting force applied by the actuators 202, 204 reduce the pressure applied by the scraper door 126 on the ground surface 102. However, the retraction of the actuators 202, 204 is not high enough to create a clearance between the scraper door 126 and the ground surface 102, thus the scraper door 128 still performs the intended cleaning function.

The control system 200 makes use of components, such as the control module 220 and the valves 218, 222, 224, 226, 228, that are already present on the milling machine 100 which in turn reduces complexity and costs. The control system 200 may be easily retrofitted on any milling machine 100 with limited software modifications, in turn, providing flexibility and compatibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof

What is claimed is:

1. A milling machine for providing a milled surface, the milling machine comprising:

a scraper door disposed on the milling machine, the scraper door configured to clean off the milled surface; and a control system adapted to control a movement of the scraper door, wherein the control system includes:

at least one actuator coupled with the scraper door, wherein an extension of the at least one actuator allows lowering of the scraper door and a retraction of the at least one actuator allows raising of the scraper door;

a first valve in fluid communication with the at least one actuator, wherein the first valve is operable in a first position for the extension of the at least one actuator and a second position for the retraction of the at least one actuator;

a second valve in fluid communication with the first valve, wherein the second valve is adapted to control an amount of fluid pressure being directed towards the at least one actuator via the first valve; and a control module communicably coupled with the first valve and the second valve, wherein the control module is configured to:

receive an input signal for raising the scraper door off the milled surface or for reducing a weight of the scraper door acting on the milled surface or for lowering the scraper door;

transmit a first signal for operating the first valve in the second position for raising the scraper door or for operating the first valve in the first position for lowering the scraper door;

transmit a second signal for controlling an amount of opening of the second valve for the retraction of the at least one actuator in order to: (a) when the input signal corresponds to raising the scraper door, raise the scraper door and (b) when the input signal corresponds to reducing the weight of the scraper door acting on the milled surface, lift the scraper door to reduce the weight of the scraper door acting on the milled surface without creating a clearance between the scraper door and the milled surface; and transmit the second signal for controlling the amount of opening of the second valve for the extension of the at least one actuator in order to lower the scraper door, wherein the amount of opening of the second valve is based on a desired fluid pressure selected by an operator, the desired fluid pressure a portion of a maximum allowable fluid pressure.

2. The milling machine of claim 1, wherein the input signal is provided by the operator of the milling machine.

3. The milling machine of claim 1, wherein the second valve includes a proportional pressure reducing valve.

4. The milling machine of claim 1, wherein the at least one actuator includes a pair of actuators.

5. The milling machine of claim 1, wherein the at least one actuator includes a hydraulic actuator.

6. The milling machine of claim 1, wherein the at least one actuator includes a head end coupled with a frame of the milling machine and a rod end coupled with the scraper door.

7. A milling machine for providing a milled surface, the milling machine comprising:

a scraper door disposed on the milling machine, the scraper door configured to clean off the milled surface; and a control system adapted to control a movement of the scraper door, wherein the control system includes:

a pair of actuators coupled with the scraper door, wherein an extension of each of the pair of actuators allows lowering of the scraper door and a retraction of each of the pair of actuators allows raising of the scraper door;

a first valve in fluid communication with the pair of actuators, wherein the first valve is operable in a first position for the extension of the pair of actuators and a second position for the retraction of the pair of actuators;

a second valve in fluid communication with the first valve, wherein the second valve is adapted to control an amount of fluid pressure being directed towards the pair of actuators via the first valve; and a control module communicably coupled with the first valve and the second valve, wherein the control module is configured to:

receive an input signal for raising the scraper door off the milled surface or for reducing a weight of the scraper door acting on the milled surface or for lowering the scraper door;

transmit a first signal for operating the first valve in the second position for raising the scraper door or for operating the first valve in the first position for lowering the scraper door;

transmit a second signal for controlling an amount of opening of the second valve for the retraction of the pair of actuators in order to: (a) when the input signal corresponds to raising the scraper door, raise the scraper door; and (b) when the input signal corresponds to reducing the weight of the scraper door acting on the milled surface, lift the scraper door to reduce the weight of the scraper door acting on the milled surface without creating a clearance between the scraper door and the milled surface; and transmit the second signal for controlling the amount of opening of the second valve for the extension of the pair of actuators in order to lower the scraper door, wherein the amount of opening of the second valve is based on a desired fluid pressure selected by an operator, the desired fluid pressure a portion of a maximum allowable fluid pressure.

8. The milling machine of claim 7, wherein the input signal is provided by the operator of the milling machine.

9. The milling machine of claim 7, wherein the second valve includes a proportional pressure reducing valve.

10. The milling machine of claim 7, wherein each of the pair of actuators includes a hydraulic actuator.

11. The milling machine of claim 7, wherein each of the pair of actuators includes a head end coupled with a frame of the milling machine and a rod end coupled with the scraper door.

12. A control system adapted to control a movement of a scraper door disposed on a machine for providing a milled surface, the scraper door configured to clean off the milled surface, the control system comprising:

at least one actuator coupled with the scraper door disposed on the machine, wherein an extension of the at least one actuator allows lowering of the scraper door and a retraction of the at least one actuator allows raising of the scraper door;

a first valve in fluid communication with the at least one actuator, wherein the first valve is operable in a first position for the extension of the at least one actuator and a second position for the retraction of the at least one actuator;

a second valve in fluid communication with the first valve, wherein the second valve is adapted to control an amount of fluid pressure being directed towards the at least one actuator via the first valve; and a control module communicably coupled with the first valve and the second valve, wherein the control module is configured to:

receive an input signal for raising the scraper door off the milled surface or for reducing a weight of the scraper door acting on the milled surface or for lowering the scraper door;

transmit a first signal for operating the first valve in the second position for raising the scraper door or for operating the first valve in the first position for lowering the scraper door;

transmit a second signal for controlling an amount of opening of the second valve for the retraction of the at least one actuator in order to: (a) when the input signal corresponds to raising the scraper door, raise the scraper door; and (b) when the input signal corresponds to reducing the weight of the scraper door acting on the milled surface, lift the scraper door to reduce the weight of the scraper door acting on the milled surface without creating a clearance between the scraper door and the milled surface; and transmit the second signal for controlling the amount of opening of the second valve for the extension of the at least one actuator in order to lower the scraper door, wherein the amount of opening of the second valve is based on the input signal, the input signal indicative of a selection of a desired fluid pressure as a percentage of a maximum allowable fluid pressure.

13. The control system of claim 12, wherein the input signal is provided by an operator of the machine.

14. The control system of claim 12, wherein the second valve includes a proportional pressure reducing valve.

15. The control system of claim 12, wherein the at least one actuator includes a pair of actuators.

16. The control system of claim 12, wherein the at least one actuator includes a hydraulic actuator.

17. The control system of claim 12, wherein the at least one actuator includes a head end coupled with a frame of the machine and a rod end coupled with the scraper door.

* * * * *